US007466937B2

(12) United States Patent
Chang

(10) Patent No.: US 7,466,937 B2
(45) Date of Patent: Dec. 16, 2008

(54) DEVELOPER CARTRIDGE, LIQUID-TYPE IMAGE FORMING APPARATUS HAVING THE SAME AND METHOD FOR DISPOSING OF THE SAME

(75) Inventor: Deuk-Hwan Chang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 200 days.

(21) Appl. No.: 11/225,342

(22) Filed: Sep. 14, 2005

(65) Prior Publication Data

US 2006/0062600 A1 Mar. 23, 2006

(30) Foreign Application Priority Data

Sep. 21, 2004 (KR) ..... 10-2004-0075349

(51) Int. Cl.
*G03G 15/08* (2006.01)
*B41J 2/165* (2006.01)

(52) U.S. Cl. ..... 399/103; 399/120; 347/36

(58) Field of Classification Search ..... 399/102, 399/103, 120, 106; 347/36
See application file for complete search history.

(56) References Cited

U.S. PATENT DOCUMENTS

| | | | | |
|---|---|---|---|---|
| 5,099,278 | A * | 3/1992 | Sato | 399/75 |
| 5,752,141 | A | 5/1998 | Nishimura et al. | |
| 6,907,213 | B2 * | 6/2005 | Fordahl et al. | 399/237 |
| 7,003,233 | B2 | 2/2006 | Matsuda et al. | |
| 2001/0033756 | A1 * | 10/2001 | Shiratori et al. | 399/103 |
| 2004/0086302 | A1 * | 5/2004 | Fordahl et al. | 399/237 |
| 2004/0091275 | A1 | 5/2004 | Matsuda et al. | |
| 2004/0105689 | A1 * | 6/2004 | Shimura et al. | 399/12 |
| 2005/0053393 | A1 * | 3/2005 | Harada et al. | 399/106 |

FOREIGN PATENT DOCUMENTS

| | | |
|---|---|---|
| CN | 1495558 | 5/2004 |
| JP | 58-181081 | 10/1983 |
| JP | 1-303479 | 12/1989 |
| JP | 05-064780 | 3/1993 |
| JP | 05-313500 | 11/1993 |
| JP | 9-218575 | 8/1997 |
| KR | 1998-0014423 | 12/1988 |
| KR | 2001-002349 | 12/2001 |
| KR | 2004-040315 | 5/2003 |
| KR | 10-2004-0040315 | 5/2004 |

* cited by examiner

*Primary Examiner*—David M Gray
*Assistant Examiner*—Joseph S. Wong
(74) *Attorney, Agent, or Firm*—Roylance, Abrams, Berdo & Goodman, L.L.P.

(57) ABSTRACT

A liquid-type image forming apparatus includes a developer cartridge, and a method for disposing of the developer cartridge. The developer cartridge includes a cartridge body having a first chamber for storing a developer and a second chamber for storing an absorber that absorbs waste developer of the first chamber. A sealing member is arranged between the first chamber and the second chamber and is configured to separate by an external force for fluidly connecting the first and second chambers.

25 Claims, 8 Drawing Sheets

DEVELOPER CARTRIDGE, LIQUID-TYPE IMAGE FORMING APPARATUS HAVING THE SAME AND METHOD FOR DISPOSING OF THE SAME

CROSS-REFERENCE TO RELATED APPLICATIONS

This application claims the benefit of Korean Patent Application No. 2004-75349, filed Sep. 21, 2004, the entire disclosure of which is hereby incorporated by reference.

BACKGROUND OF THE INVENTION

1. Field of the Invention

The present invention relates to an image forming apparatus. More particularly, the present invention relates to a developer cartridge for a liquid-type image forming apparatus and a method for disposing of the same.

2. Description of the Related Art

Generally, image forming apparatuses are divided into monochromatic image forming apparatuses and color image forming apparatuses. Monochromatic image forming apparatuses implement images in black and white by using only a one-color developer. Color image forming apparatuses implement colorful images by using developers of various colors, which are typically magenta, cyan, yellow and black.

An electrophotographic image forming apparatus forms an electrostatic latent image on an organic photoconductor, charged by a charging unit, to have a predetermined potential by a laser beam emitted from a laser scanning unit. The electrostatic latent image is developed with a developer and transferred into a visible image on paper. In a color image forming apparatus, an organic photoconductor of each color is developed with developers of each color. Then, the developed images are overlapped and transferred to an intermediate transfer medium, such as an intermediate transfer belt (ITB). A color image obtained by overlapping images of each color on the intermediate transfer medium is transferred onto printing paper. The printing paper containing the color image goes through a series of fixing processes and is discharged out of the image forming apparatus.

FIG. 1 shows a structure of a conventional color image forming apparatus that performs a two-step transfer operation by using an intermediate transfer belt. Referring to FIG. 1, the color image forming apparatus comprises an intermediate transfer belt 10, a supporting roller 11, first transfer (T1) rollers 12, 13, 14 and 15 for each color, organic photoconductors 16, 17, 18 and 19 for each color, a second transfer (T2) roller 20, and a belt driving roller 21.

On the organic photoconductors 16, 17, 18 and 19 of each color, developers of black (K), cyan (C), magenta (M), and yellow (Y) colors are attached to an electrostatic latent image area through a developing process. For each color, the T1 rollers 12, 13, 14 and 15 are set up to correspond to the organic photoconductors 16, 17, 18 and 19 with the intermediate transfer belt 10 between them. Accordingly, the developers attached to the surface of the organic photoconductors 16, 17, 18 and 19 are transferred onto the surface of the intermediate transfer belt 10 primarily by transfer operations of the T1 rollers 12, 13, 14 and 15. Herein, the T1 rollers 12, 13, 14 and 15 are placed with a predetermined interval so that the developers of each color transferred from the organic photoconductors 16, 17, 18 and 19 onto the intermediate transfer belt 10 are overlapped in the same location. The developers are primarily overlapped on the intermediate transfer belt 10 to thereby form one complete color image. Subsequently, the color image on the intermediate transfer belt 10 goes through a secondary transfer operation between the T2 transfer roller 20 and the belt driving roller 21. The color image is then transferred onto a printing medium 23.

Meanwhile, the image forming apparatus includes developing units 26, 27, 28 and 29 for each color in order to develop the organic photoconductors 16, 17, 18 and 19 with the developers of each color. Each of the developing units 26, 27, 28 and 29 is provided with a developer from each of developer cartridges 36, 37, 38 and 39 for each color by using a pump (P). Waste developer, including a liquid carrier remaining after being used in the developing units 26, 27, 28 and 29, is collected into the developer cartridges.

Meanwhile, the developer cartridges 36, 37, 38 and 39 of each color are connected with the developing units 26, 27, 28 and 29 when they are set up in the image forming apparatus to thereby supply the developers. The developer cartridges 36, 37, 38 and 39 should be replaced with new ones when the developers accommodated in the developer cartridges are all consumed. However, when the developer cartridges 36, 37, 38 and 39 are separated out of the image forming apparatus for disposal, the collected waste developer, including the liquid carrier, remains inside. Therefore, when the developer cartridges 36, 37, 38 and 39 are separated, waste developer leakage may be a problem.

Accordingly, there is a need for an improved image forming apparatus having a developer cartridge to prevent leakage of waste developer.

SUMMARY OF THE INVENTION

An aspect of the present invention is to solve at least the above problems and/or disadvantages and to provide at least the advantages described below. Accordingly, an aspect of the present invention is to provide a developer cartridge improved to prevent leakage of waste developer, a liquid-type image forming apparatus comprising the same, and a method for disposing of the developer cartridge.

In accordance with an aspect of the present invention, there is provided a developer cartridge of an image forming apparatus. The developer cartridge has a cartridge body having a first chamber which stores a developer and a second chamber which stores an absorber that absorbs waste developer of the first chamber. A sealing member is disposed between the first chamber and the second chamber. The sealing member is configured to separate via an external force to fluidly connect the first and second chambers.

The cartridge body may include a housing to form the first chamber and has an opened upper part. A cover is connected with the upper part of the housing and has the second chamber.

The sealing member preferably is a flexible film attached to a brim of the second chamber.

Preferably, the film comprises metal.

The sealing member preferably is attached to the brim of the second chamber by welding.

The developer cartridge may further comprise an agitator which is rotatably mounted in the first chamber to agitate the developer. A seal removing unit selectively receives power from the agitator to separate the sealing member and move the absorber of the second chamber into the first chamber.

The seal removing unit may include a collector rotatably mounted in the first chamber to windingly collecting the sealing member during rotation. A one-way clutch may also be provided to selectively transfer rotational power of the agitator to the collector in a rotational direction of the agitator.

The seal removing unit may further comprise a secondary gear formed along substantially the same axis as the collector. An idle gear connects power of the one-way clutch to the secondary gear.

The one-way clutch preferably comprises a driving clutch formed in a rotary shaft of the agitator. A secondary clutch is mounted in contact with the driving clutch to receive power from the driving clutch in one direction and to transfer the power to the idle gear. A spring presses the secondary clutch toward the driving clutch.

The second chamber includes an axial boss which rotatably supports the secondary clutch and the rotary shaft of the agitator.

The idle gear preferably is a screw gear.

The sealing member is preferably a flexible film attached to the brim of the second chamber by welding.

The film is preferably folded in two folds, one of the folds having an upper layer attached to the brim of the second chamber and a lower layer connected with the collector.

In order to achieve another aspect of the present invention, there is provided a liquid-type image forming apparatus, comprising developer cartridges for each color, including a first chamber which stores a developer to be supplied to a developing unit for each color and a second chamber which stores an absorber that absorbs waste developer of the first chamber. A sealing member isolates the second chamber from the first chamber. The sealing member is configured to separate via an external force. A driving unit supplies power to developer cartridges for each color. A control unit monitors a consumed quantity of a developer of each developer cartridge and controls the driving unit to selectively supply the developer cartridge power to remove the sealing member of the developer cartridge in which the developer is consumed.

The driving unit may comprise a driving motor capable of rotating in both directions and driving gears for each color disposed to correspond to the developer cartridges for each color, respectively, to rotate simultaneously by power transmitted from the driving motor. Intermittent clutches are disposed between the developer cartridges for each color and the driving gears to selectively control the power via the control unit.

The control unit preferably monitors consumed quantity of the developers of the developer cartridges for each color by counting the number of dots for each data with respect to inputted printing data.

In order to achieve yet another aspect of the present invention, there is provided a method for disposing of a developer cartridge in a liquid-type image forming apparatus, comprising the steps of a) consuming a developer in a first chamber isolated by a sealing member from a second chamber containing an absorber for absorbing liquid, b) monitoring consumed quantity of a developer of the first chamber, and c) solidifying waste developer in the first chamber by using the absorber of the second chamber based on the monitoring result.

The step c) comprises the steps of c1) removing the sealing member to move the absorber of the second chamber into the first chamber and c2) mixing the absorber of the second chamber with the waste developer of the first chamber.

The step c1) comprises the steps of c1-1) rotating backward an agitator mounted in the first chamber; c1-2) transferring a backward rotational force of the agitator to a collector rotatably mounted in the second chamber; and c1-3) winding and collecting the sealing member by rotating the collector.

The step b) includes the steps of b1) counting the number of dots of inputted print data, b2) adding up the number of dots counted, and b3) determining whether a developer is consumed completely by comparing the total dot number with a reference value.

Still another aspect of the present invention can be achieve by providing a method for disposing of a developer cartridge in a liquid-type image forming apparatus, comprising the steps of a) consuming a developer of each color stored in a first chamber of each developer cartridge for each color, b) monitoring a replacement time of a developer cartridge for each color, and c) solidifying waste developer in a developer cartridge to be replaced.

The step a) includes the steps of a1) rotating forward an agitator mounted in a developer cartridge for each color and a2) supplying the developer of the first chamber to a developing unit.

The step c) includes the steps of c1) removing a sealing member isolating a first chamber from a second chamber containing an absorber for absorbing a developer and c2) moving the absorber of the second chamber into the first chamber and mixing the waste developer of the second chamber with the absorber.

The step c1) includes the steps of c1-1) rotating backward an agitator of a developer cartridge to be replaced, c1-2) transferring power of the agitator to a collector rotatably mounted in the second chamber, and c1-3) collecting the sealing member by rotating the collector.

The step a1) includes the steps of a1-1) rotating backward a driving motor, a1-2) turning on a intermittent clutch that transfers power from the driving motor to the developer cartridge to be replaced, and a1-3) turning off a intermittent clutch that transfers power from the driving motor to a developer cartridge which is not an object of the developer cartridge replacement.

The step b) includes the steps of b1) counting the number of dots for each color with respect to inputted printing data, b2) adding up the counted number of dots for each color, and b3) determining a replacement time of a developer cartridge by comparing the total dot number for each color with a reference value.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
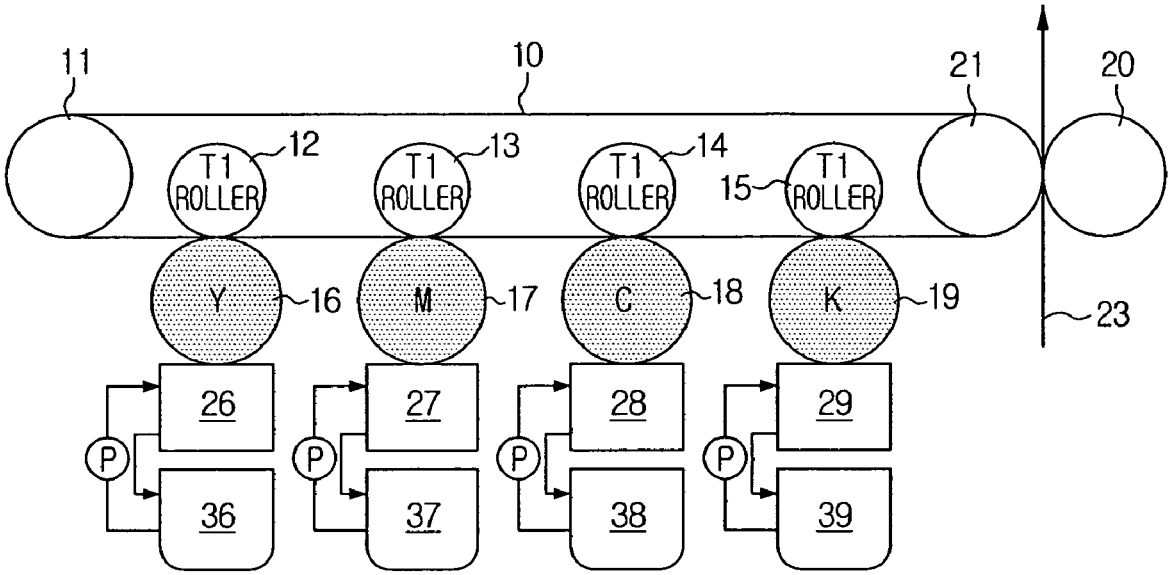
FIG. 1 (PRIOR ART)
FIG. 1 is a schematic diagram of a conventional color image forming apparatus.
Figure 2:
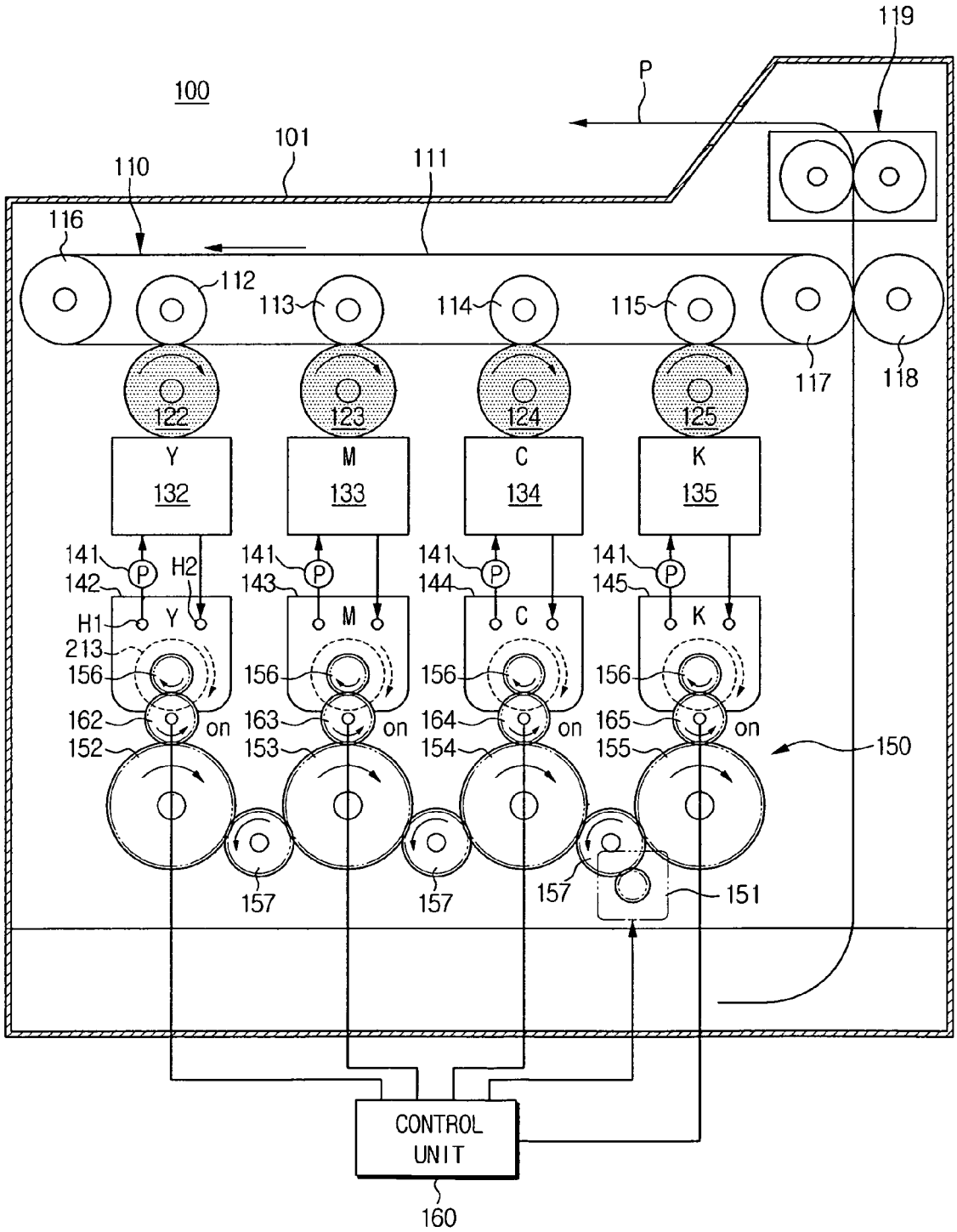
FIG. 2 is a diagram of a liquid-type image forming apparatus in accordance with an embodiment of the present invention.

Referring to FIG. 2, which is a diagram illustrating a liquid-type image forming apparatus in accordance with an embodiment of the present invention, the liquid-type image forming apparatus 100 comprises a transferring unit 110, a fixing unit 119, organic photoconductors 122, 123, 124 and 125 for each color, developing units 132, 133, 134 and 135 for each color, developer cartridges 142, 143, 144 and 145 for each color, a driving unit 150, and a control unit 160.

The transferring unit 110 includes an intermediate transfer belt 111 as an intermediate transfer medium, a plurality of first transfer (T1) rollers 112, 113, 114 and 115, and a second transfer (T2) roller 118. The intermediate transfer belt 111 runs on an endless track via a supporting roller 116 and a driving roller 117. Color images are transferred onto the intermediate transfer belt 111 from the organic photoconductors 122, 123, 124 and 125 and are overlapped with one another. The T1 rollers 112, 113, 114 and 115 and the organic photoconductors 122, 123, 124 and 125 face each other with the intermediate transfer belt 111 arranged therebetween. The T2 roller 118 rotates in contact with the intermediate transfer belt 111. The color images transferred and overlapped on the intermediate transfer belt 111 are then transferred onto a printing medium (P). The fixing unit 119 includes a heating roller and a pressing roller which rotate in contact with each other. The printing medium (P) passes between the heating roller and the pressing roller, and the color image is fixed on the printing medium (P) by application of high temperatures and pressures.

The organic photoconductors 122, 123, 124 and 125 for each color overlap color images on the intermediate transfer belt 111. In the one exemplary embodiment, the organic photoconductors 122, 123, 124 and 125 for each color are arrayed to form a yellow (Y) image, a magenta (M) image, a cyan (C) image, and a black (K) image along a running direction of the intermediate transfer belt 111. The organic photoconductors 122, 123, 124 and 125 for each color are charged to have a predetermined potential on the surface by a charging unit (not shown). The surfaces of the charged organic photoconductors 122, 123, 124 and 125 are partially exposed to light by a laser scanning unit (not shown) to thereby form an electrostatic latent image that corresponds to desired image data. Developers of each color supplied by the developing units 132, 133, 134 and 135 are attached to the electrostatic latent image areas of the organic photoconductors 122, 123, 124 and 125 to thereby form images of each color. Each of the developing units 132, 133, 134 and 135 preferably has substantially the same structure. Conventionally, each developing unit includes a developing roller, a cleaner for cleaning the developing roller, and a developer supplying nozzle for supplying the developer to the developing roller. Herein, the developer used for the development is an ink comprising powder-type toner of a predetermined color and liquid carrier.

The developer cartridges 142, 143, 144 and 145 accommodate developers of each color to be supplied to the developing units 132, 133, 134 and 135 corresponding thereto. The developers of the developer cartridges 142, 143, 144 and 145 are supplied by a supply pump 141 to the developing units 132, 133, 134 and 135 through a supply path. The waste ink, remaining after being used in the developing units 132, 133, 134 and 135, that is, the liquid carrier, is collected into the developer cartridges 142, 143, 144 and 145 through a collection path.

Each of the developer cartridges 142, 143, 144 and 145 has the same structure, but, the color of the developers stored therein typically differs. The developer cartridges 142, 143, 144 and 145 are consuming goods that should be replaced with new ones after the developers in the cartridges are all consumed. Thus, the developer cartridges 142, 143, 144 and 145 are detachably mounted in a main body 101 of the image forming apparatus. The developer cartridges, 142, 143, 144 and 145 are connected to fit into the supply and collection paths of the developers. The remaining quantity of the developer of each developer cartridge is measured by counting the number of dots of each color based on inputted color printing data. The control unit 160 compares the counted dot number of a predetermined color to a reference value and determines whether to replace the developer cartridge.

For convenience of explanation, since the developer cartridges 142, 143, 144 and 145 for each color have the same structure, exemplary embodiments of the present invention will be described in detail by describing the yellow color developer cartridge 142 of FIG. 3, hereinafter.

Figure 3:
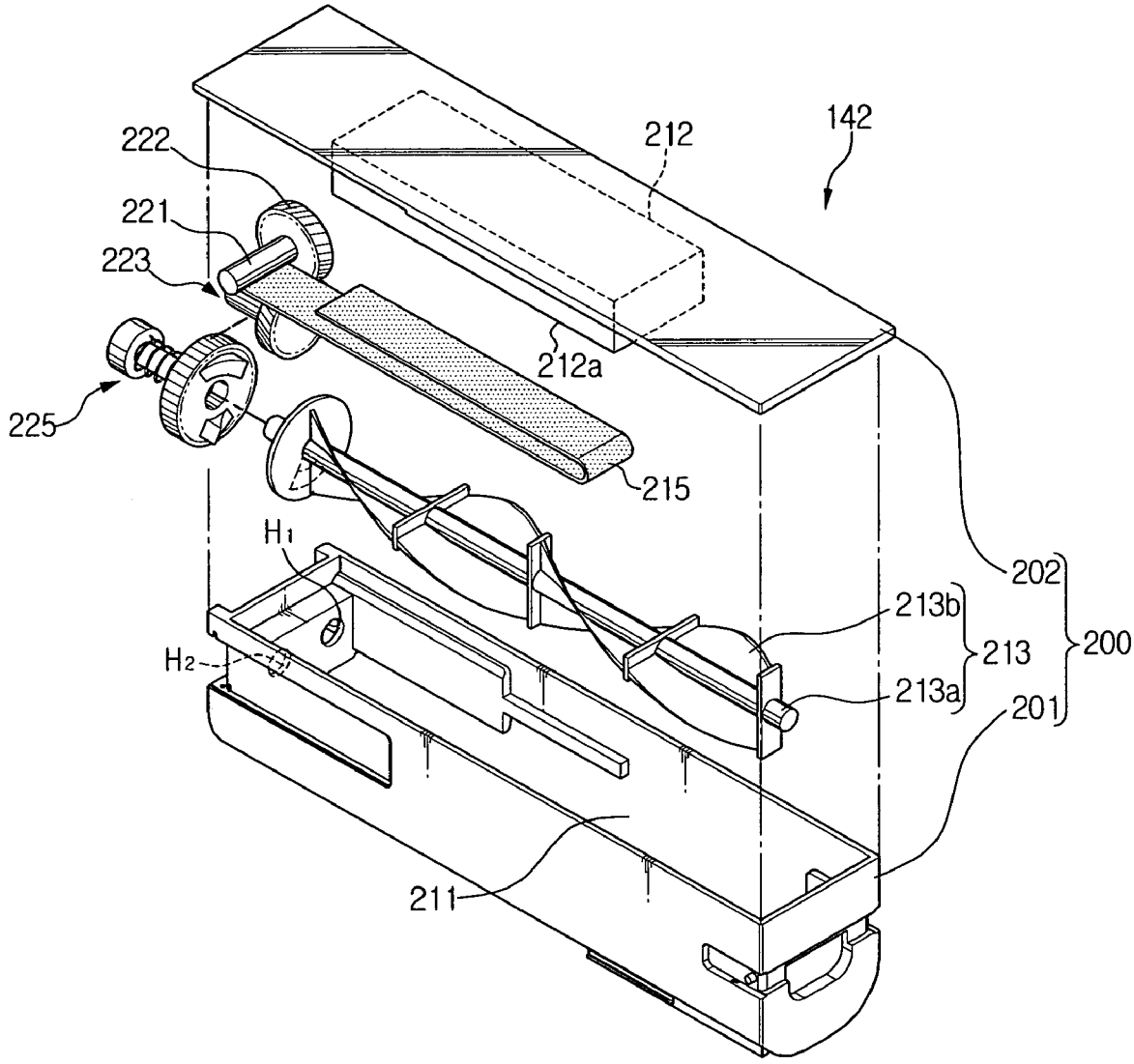
FIG. 3 is an exploded perspective diagram showing a developer cartridge in accordance with an embodiment of the present invention.
Figure 4:
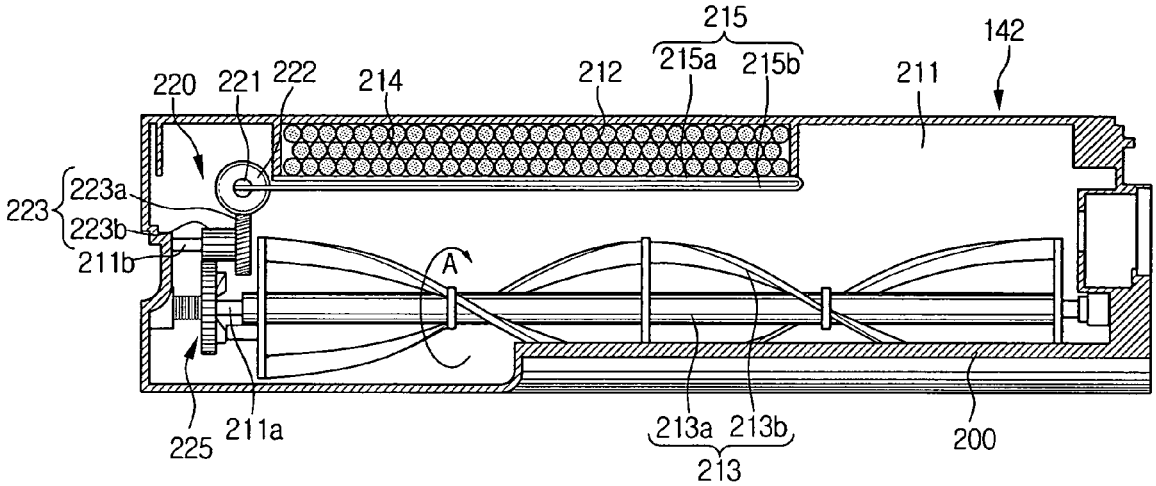
FIG. 4 is a cross-sectional diagram showing a developer cartridge of FIG. 3.

Referring to FIGS. 3 and 4, the developer cartridge 142 comprises a cartridge body 200 having a first chamber 211 for accommodating a developer and a second chamber 212 for accommodating an absorber 214. An agitator 213 is provided for agitating the developer in the cartridge body 200. Moreover, a sealing member 215 and a seal remover 220 are also provided.

The cartridge body 200 comprises a housing 201 for forming the first chamber 211 and a cover 202 connected to an upper part of the housing 201. The second chamber 212 is positioned at a lower part of the cover 202.

The first chamber 211 contains the developer, which is a mixture of the powder-type toner of a predetermined color, and a liquid carrier. The first chamber 211 includes a supply port (H1) for supplying the developer and a collecting port (H2) for collecting the developer remaining after being used in the developing unit 132.

The second chamber 212 having a predetermined volume is provided in the upper part of the first chamber 211. The second chamber 212 contains the absorber 214 that absorbs and solidifies the waste developer which is collected after using the developer of the first chamber 211. The developer 214, for example, has a function of absorbing and solidifying liquid. The second chamber 212 is separated from the first chamber 211 by the sealing member 215. That is, the sealing member 215 is connected with a lower part of the second chamber 212 to isolate the second chamber 212 from the developer of the first chamber 211. Preferably, the sealing member 215 is a metal film. The sealing member 215 is set up having two-folds. Thus, an upper layer 215*a* of the sealing member 215 is attached to a brim 212*a* of the second chamber 212 by a double-sided adhesive tape, an adhesive, laser welding, or ultrasonic welding. A lower layer 215*b* of the sealing member 215 connects with the collector 221 of the second chamber 212. Preferably, the collector 221 of the second chamber is a collecting shaft rotatably mounted in the upper part of the first chamber 211. When the collector 221 is rotated, the sealing member 215 is wound on the collector 221. Thus, the sealing member 215 separates from the second chamber 212, and the second chamber 212 and the first chamber 211 are open to each other. Therefore, the absorber 214 in the second chamber 212 pours into the first chamber 211, and mixes with the waste developer of the first chamber 211. The collector 221 can be selectively rotated by receiving power from the agitator 213.

The agitator 213 is rotatably arranged in the first chamber 211. The agitator 213 includes a rotary shaft 213*a* and an agitating wing 213*b* connected to the rotary shaft 213*a*. The agitator 213 rotates by receiving power from the driving unit 150 and mixes the developer. One end of the rotary shaft 213*a* is rotatably supported by an axial boss 211*a* in the first chamber 211, while the other end of the rotary shaft 213*a* is inserted into a side wall of the first chamber 211 and is also preferably rotatably arranged. The other end of the rotary shaft 213*a* is operatively connected with the driving unit 150.

The sealing member 215 separates the second chamber 212 from the first chamber 211. The sealing member 215 is mounted in two folds. The lower layer 215*b* of the sealing member 215, while it remains folded with the upper layer 215*a* and the end of the lower layer 215*b*, is connected to the collector 221. Preferably, the sealing member 215 is a metal film. The sealing member 215 should not be removed until the developer in the first chamber 211 is all consumed. After the developer in the first chamber 211 is used up, the sealing member 215 is removed prior to replacement of the developer cartridge 142 so that the absorber 214 in the second chamber 212 can move into the first chamber 211.

The seal remover 220 removes and collects the sealing member 215. For this purpose, the seal remover 220 includes the collector 221, a secondary gear 222, an idle gear 223, and a one-way clutch 225.

The collector 221 is rotatably arranged in the upper part of the first chamber 211 and is connected with one end of the sealing member 215. When the collector 221 rotates, the sealing member 215 is wound on the collector 221. The idle gear 223 is set up to be rotatable with respect to a stud 211*b* of the first chamber 211. The idle gear 223 includes a screw gear 223*a* connected to the secondary gear 222 and a connection gear 223*b* formed along substantially the same axis as the screw gear 223*a*. The connection gear 223*b* is connected with a clutch gear 233*a* which will be described later.

Figure 5:
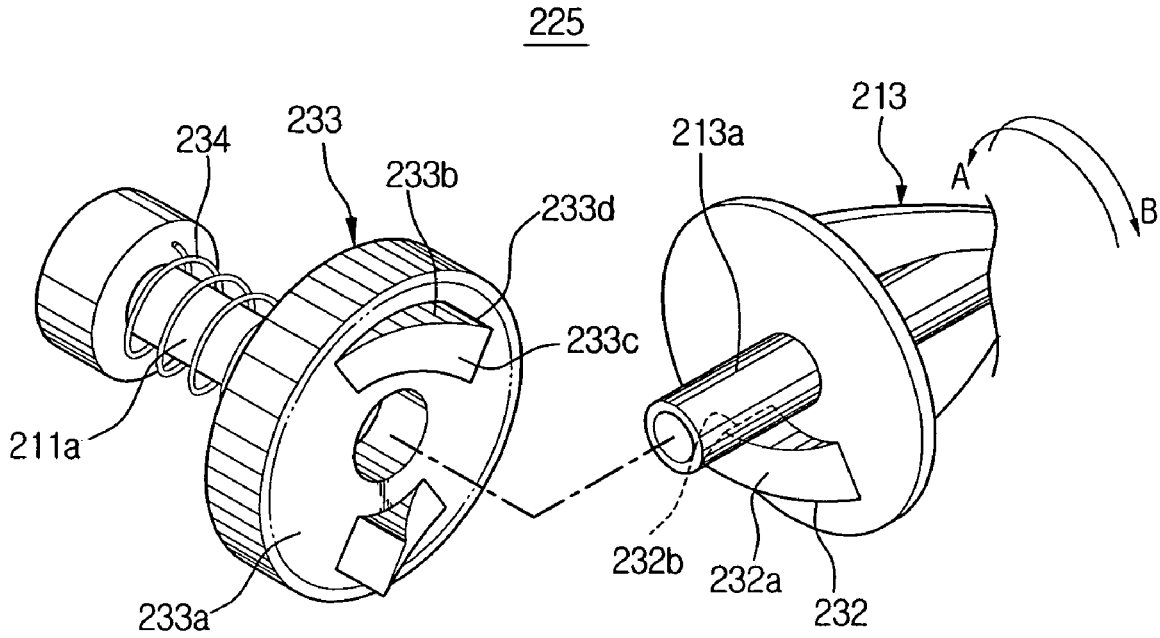
FIG. 5 is an exploded perspective diagram showing the one-way clutch of FIG. 4.

Referring to FIG. 5, the one-way clutch 225 includes a driving clutch 232 provided in the rotary shaft 213*a* of the agitator 213. A secondary clutch 233 is rotatably arranged opposite to the driving clutch 232, and a spring 234. The driving clutch 232 is provided with a first inclined plane 232*a* for performing a gliding movement against the secondary clutch 233, when the driving clutch 232 rotates in one direction (A), and a first step plane 232*b* for transferring power through the secondary clutch 233 when the driving clutch 232 rotates in the other direction (B). The driving clutch 232 can be integrated with one end of the rotary shaft 213*a*.

The secondary clutch 233 is rotatably mounted and slidably arranged with respect to the axial boss 211*a*. The secondary clutch 233 includes a clutch gear 233*a* having gear teeth in the external circumference and an inclined protrusion 233*b* which extends toward a cross-section of the clutch gear 233*a*. The inclined protrusion 233*b* is provided with a second inclined plane 233*c* and a second step plane 233*d* that corresponds to the first inclined plane 232*a* and the second step plane 233*d*, respectively.

The spring 234 is set up in the axial boss 211*a* and presses the secondary clutch 233 toward the driving clutch 232. Thus, the driving clutch 232 and the secondary clutch 233 are in contact with each other. When the agitator 213 rotates in the A direction, the first and second inclined planes 232*a* and 233*c* glide towards each other. Thus, power is not transferred to the secondary clutch 233. If the agitator 213 rotates in the B direction, the first and second step planes 232*b* and 233*d* are engaged with each other and make the secondary clutch 233 rotate.

The driving unit 150, as illustrated in FIG. 2, includes a driving motor 151, driving gears 152, 153, 154 and 155 which are set up to confront the developer cartridges 132, 133, 134 and 135 of each color, agitating gears 156 that are connected with the agitator of the developer cartridges 132, 133, 134 and 135 of each color, and intermittent clutches 162, 163, 164 and 165 connecting the driving gears 152, 153, 154 and 155 and the agitating gears 156. The driving motor 151 is rotatable in both directions. The driving gears 152, 153, 154 and 155 are connected by connecting gears 157 and rotate simultaneously.

Preferably, the intermittent clutches 162, 163, 164 and 165 are electronic clutches that are turned on/off selectively by the control of the control unit 160. Since each of the intermittent clutches 162, 163, 164 and 165 can be turned on/off independently, the power of each driving gear 152, 153, 154 or 155 can be transferred to each developer cartridge 142, 143, 144 or 145 selectively.

The control unit 160 controls the entire operation of the image forming apparatus. To be specific, the control unit 160 monitors the replacement time or the consumed quantity of each developer of a color based on inputted print data. That is, the control unit 160 counts and adds up the number of dots of print data for each color, compares the total number of dots for each color with a predetermined reference value to determine whether the developer of each color is consumed completely and determines the replacement time for the developer cartridge.

If it is determined that the developer cartridge completely runs out of the developer, the control unit 160 controls the driving unit 150 to perform replacement operations to separate the developer cartridge which runs out of the developer.

Hereinafter, a method for disposing of a developer cartridge in a liquid-type color image forming apparatus according to an exemplary embodiment of the present invention, with reference to FIGS. 2 to 8, will be explained.

When printing begins, as illustrated in FIG. 2, the developers are supplied and consumed from the developer cartridges 142, 143, 144 and 145 for each color to the developing units 132, 133, 134 and 135 for each color and the developers in the developer cartridges 142, 143, 144 and 145 for each color are agitated (S10). To agitate the developers, the control unit 160 turns on the intermittent clutches 162, 163, 164 and 165, while driving the driving motor 151 in the forward direction. Then, the agitating gears 156 of the developer cartridges 142, 143, 144 and 145 rotate in the forward direction, which is clockwise in FIG. 2, and drive the agitators 213 in the forward direction as well. Herein, as described with reference to FIG. 4, the power of the agitators 213 is not transferred to the collector 221 due to the one-way clutch 225.

Meanwhile, while the printing operation is performed by consuming the developers of each color, the control unit 160 monitors the consumed quantity of the developers of each color based on the inputted print data (S11). In other words, the control unit 160 counts the number of dots for each color based on the input data and calculates the number of dots for all the colors. Then, the control unit 160 compares the total number of the dots for all the colors to a predetermined reference value to see if the total dot number exceeds the reference value. Thus, it may be determined if there is a completely consumed color developer (S12).

If it is determined that the developer is completely consumed at step S12, the waste developer that remains in the developer cartridge is solidified for replacement (S13).

To be more specific, at step S14, the control unit 160 stops the printing operation. Then, at step S15, the control unit 160 stops the driving motor 151 to suspend the forward rotation of the agitator 213.

Figure 6:
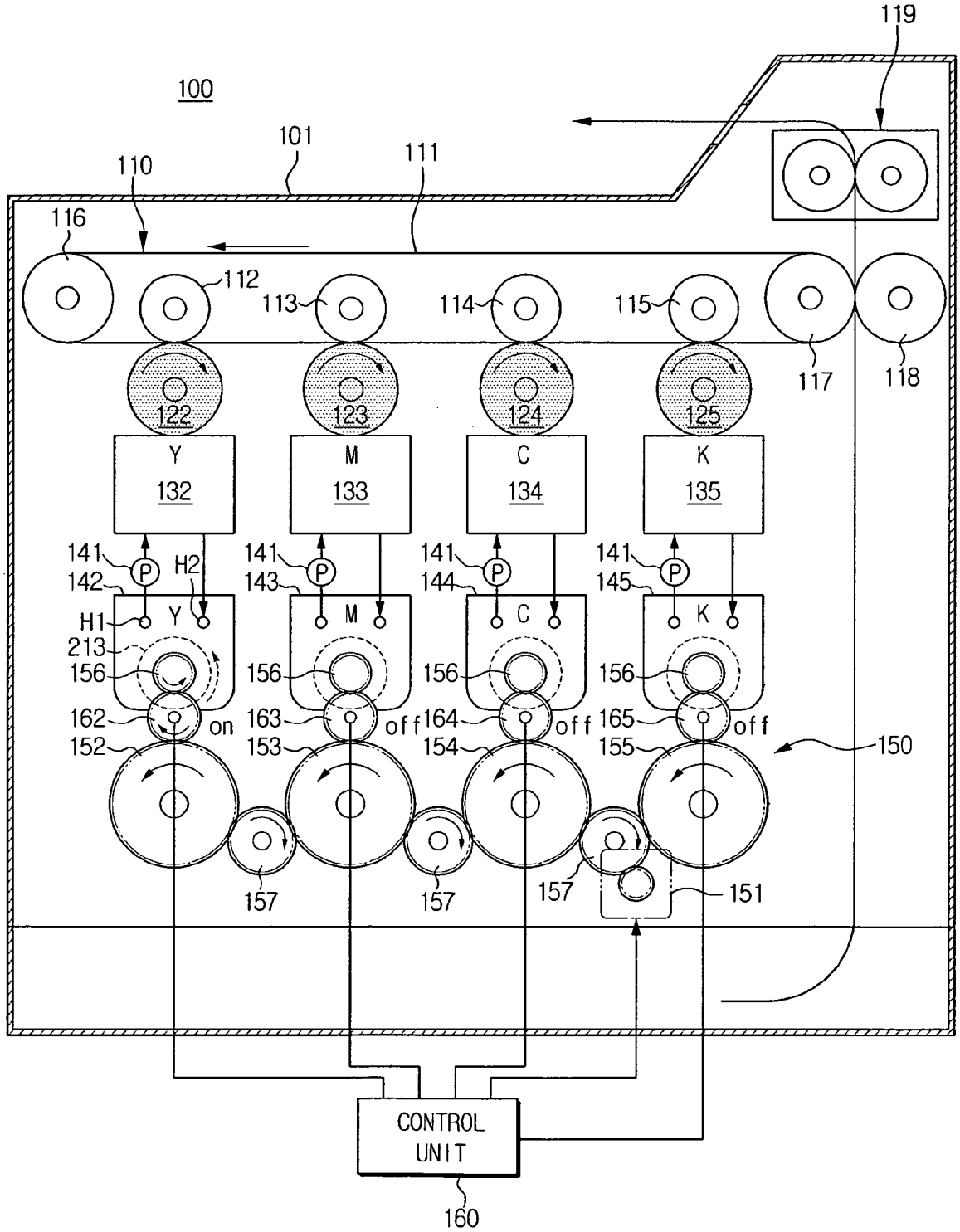
FIG. 6 is a diagram illustrating the operations of suspending a printing operation and solidifying waste developer.

Subsequently, at step S16, an intermittent clutch 162 corresponding to the developer cartridge 142 to be replaced is turned on (at this point it is assumed that the yellow developer cartridge 142 is consumed completely). That is, as illustrated in FIG. 6, the power of the driving motor 151 is prevented from being transferred to other developer cartridges 143, 144 and 145 which are not the object of the replacement by turning off the other intermittent clutches 163, 164 and 165.

Figure 7:
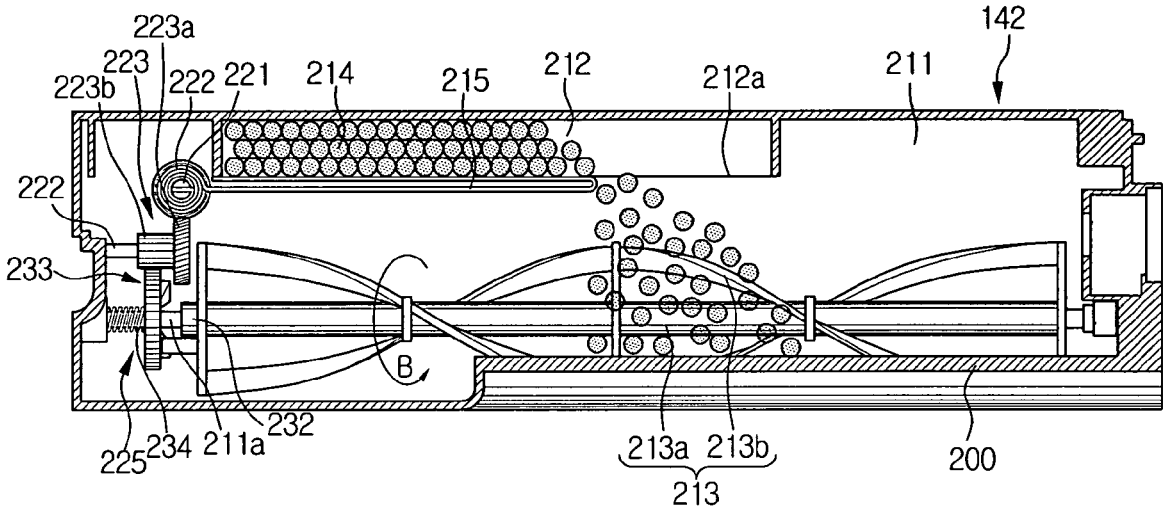
FIG. 7 is a cross-sectional diagram depicting an operation of removing a sealing member by rotating an agitator backward.
Figure 8:
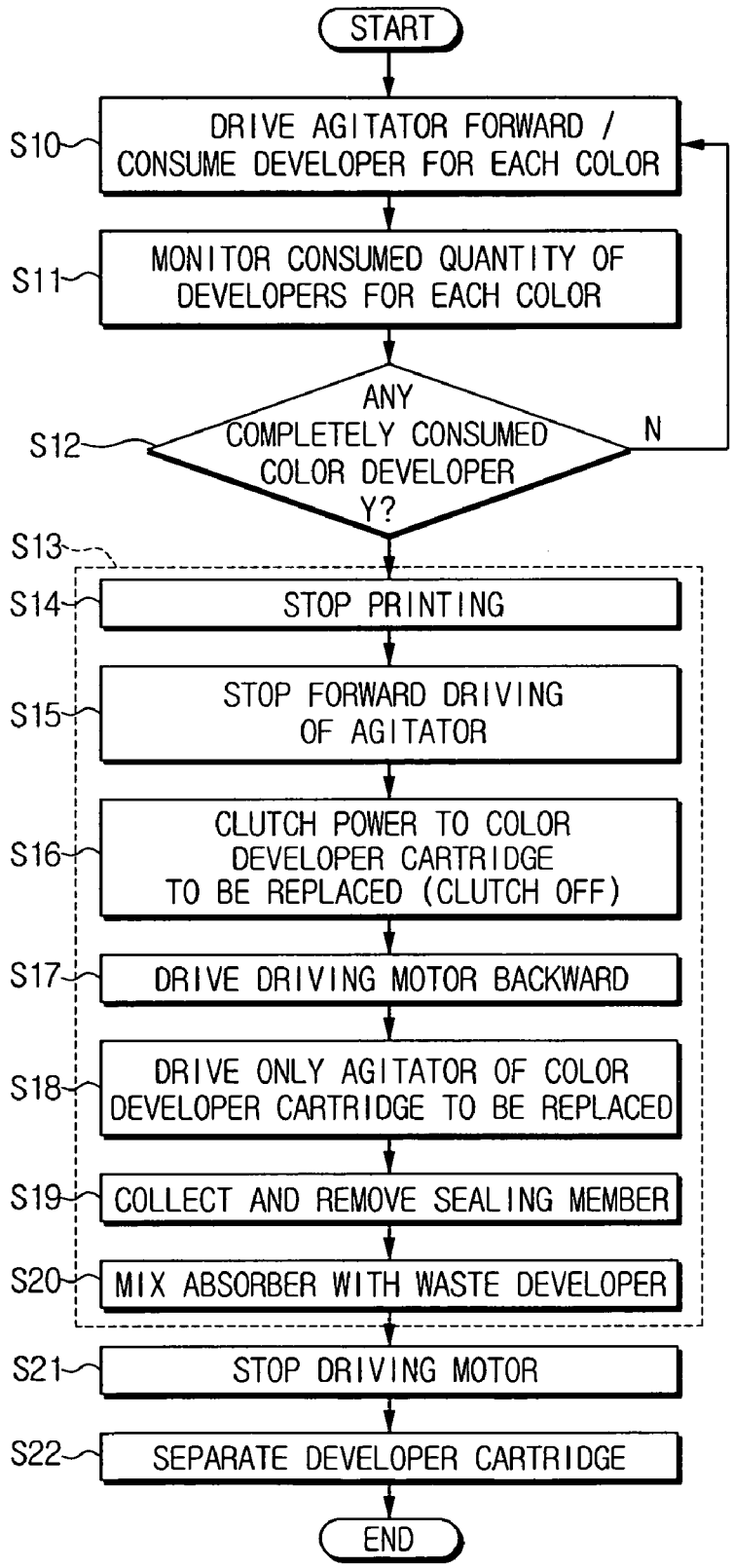
FIG. 8 is a flowchart describing a method for disposing of a developer cartridge of an image forming apparatus in accordance with an embodiment of the present invention.

As shown in FIG. 7, at step S17, the driving motor 151 is rotated in the B direction, which is the backward direction. Then, at step S18, only the agitator 213 of the yellow color developer cartridge 142 rotates backward, while the driving gears 152, 153, 154 and 155 rotate backward.

If the agitator 213 makes a backward rotation, the one-way clutch 225 is operated to transfer the power of the agitator 213 to the idle gear 223 and the secondary gear 222. Thus, at step S19, the collector 221 rotates and collects the seal member 215 by winding the sealing member 215. Then, since the sealing member 215 is separated from the brim 212*a* of the second chamber 212 and wound on the collector 221, at step S20, the absorber 214 stored in the second chamber 212 pours into the first chamber 211 for mixing with the waste developer.

Herein, while the sealing member 215 is wound and collected, the agitator 213 continues to rotate. Therefore, the poured absorber 214 is quickly mixed with the agitator 213 to thereby shorten the solidification time.

Subsequently, at step S21, the waste developer is solidified by removing the sealing member 215 and the control unit 160 stops the operation of the driving motor 151. Then, at step S22, a user separates the yellow developer cartridge 142 from the main body 101 of the image forming apparatus. The process of replacing a cartridge with a new developer cartridge is completed by mounting the new developer cartridge after separation.

As described above, the present invention includes the developer cartridge, the image forming apparatus comprising the same, and the method for disposing of a developer cartridge can solidify the waste developer before the detachment of the developer cartridge. Therefore, contamination by the waste developer can be prevented.

Also, while the absorber for solidifying the waste developer is in the developer cartridge, the waste developer is mixed with the absorber after the developer is consumed. Therefore, the waste developer of each color developer cartridge can be easily replaced individually, which makes the printing operation convenient.

In addition, since the absorber is mixed with the waste developer by using the power of the agitator, the structure is simple and operational costs can be minimized.

While the invention has been shown and described with reference to certain embodiments thereof, it will be understood by those skilled in the art that various changes in form and details may be made therein without departing from the spirit and scope of the invention as defined by the appended claims.

What is claimed is:

1. A developer cartridge of an image forming apparatus, comprising:

a cartridge body having a first chamber which stores a developer and a second chamber which stores an absorber that absorbs waste developer of the first chamber;

a sealing member disposed between the first chamber and the second chamber, the sealing member configured to separate via an external force to fluidly connect the first and second chambers;

an agitator rotatably mounted in the first chamber to agitate the developer; and a seal removing unit, which selectively receives power from the agitator during operation of the agitator to separate the sealing member to move the absorber of the second chamber into the first chamber.

2. The developer cartridge as recited in claim 1, wherein the cartridge body comprises:

a housing forming the first chamber and having an opened upper part; and a cover connected with the upper part of the housing and having the second chamber.

3. The developer cartridge as recited in claim 1, wherein the sealing member is a flexible film attached to a brim of the second chamber.

4. The developer cartridge as recited in claim 3, wherein the film comprises metal.

5. The developer cartridge as recited in claim 3, wherein the sealing member is attached to the brim of the second chamber by welding.

6. The developer cartridge as recited in claim 1, wherein the seal removing unit includes:

a collector rotatably mounted in the first chamber to windingly collect the sealing member during rotation; and a one-way clutch to selectively transfer rotational power of the agitator to the collector in a rotational direction of the agitator.

7. The developer cartridge as recited in claim 6, wherein the seal removing unit further comprises:

a secondary gear formed substantially along the same axis as the collector; and an idle gear connecting power of the one-way clutch to the secondary gear.

8. The developer cartridge as recited in claim 7, wherein the idle gear is a screw gear.

9. The developer cartridge as recited in claim 6, wherein the one-way clutch comprises:

a driving clutch formed on a rotary shaft of the agitator;

a secondary clutch operatively connected with the driving clutch to receive power from the driving clutch in one direction and transfer the power to the idle gear; and a spring to pressing the secondary clutch toward the driving clutch.

10. The developer cartridge as recited in claim 9, wherein the second chamber includes an axial boss which rotatably supports the secondary clutch and the rotary shaft of the agitator.

11. The developer cartridge as recited in claim 1, wherein the sealing member is a flexible film attached to the brim of the second chamber by welding.

12. The developer cartridge as recited in claim 11, wherein the film is folded in two folds, one of the folds having an upper layer attached to the brim of the second chamber and the other fold having a lower layer connected with the collector.

13. A liquid-type image forming apparatus, comprising:

respective developer cartridges for plural colors, each developer cartridge including a first chamber that stores a developer to be supplied to a developing unit for one of the colors and a second chamber that stores an absorber that absorbs waste developer of the first chamber, and a sealing member isolating the second chamber from the first chamber, the sealing member being configured to separate via an external force;

a driving unit to supply power to developer cartridges for each color; and a control unit which monitors a consumed quantity of a developer of each developer cartridge and controlling the driving unit to selectively supply power to the developer cartridges to remove the sealing member of the developer cartridge in which the developer is consumed;

wherein each developer cartridge further comprises:

a developer agitator, which rotates bi-directionally in the first chamber and which selectively receives power from the driving unit; and a seal removing unit, which selectively receives power from the agitator to separate the sealing member and to move the absorber of the second chamber to the first chamber.

14. The liquid-type image forming apparatus as recited in claim 13, wherein the seal removing unit comprises:

a collector rotating in the first chamber to windingly collect the sealing member during rotation; and a one-way clutch, which selectively transfers power of the agitator to the collector in a rotational direction of the agitator.

15. The liquid-type image forming apparatus as recited in claim 14, wherein the seal removing unit further comprises:

a secondary gear formed substantially along the same axis as the collector; and a screw gear connecting power of the one-way clutch to the secondary gear.

16. The liquid-type image forming apparatus as recited in claim 13, wherein the sealing member is attached to the brim of the second chamber by welding and the sealing member is a flexible film.

17. The liquid-type image forming apparatus as recited in claim 16, wherein the film comprises metal.

18. The liquid-type image forming apparatus as recited in claim 13, wherein the control unit monitors consumed quantity of the developers of the developer cartridges for each color by counting the number of dots for each data with respect to inputted printing data.

19. The liquid-type image forming apparatus, comprising:

respective developer cartridges for plural colors, each developer cartridge including a first chamber that stores a developer to be supplied to a developing unit for one of the colors and a second chamber that stores an absorber that absorbs waste developer of the first chamber, and a sealing member isolating the second chamber from the first chamber, the sealing member being configured to separate via an external force;

a driving unit to supply power to developer cartridges for each color; and a control unit which monitors a consumed quantity of a developer of each developer cartridge and controlling the driving unit to selectively supply power to the developer cartridges to remove the sealing member of the developer cartridge in which the developer is consumed;

wherein the driving unit comprises:

a driving motor capable of rotating in both directions;

driving gears for each color, disposed to correspond to the developer cartridges for each color, respectively, to rotate simultaneously via power transmitted from the driving motor; and intermittent clutches disposed between the developer cartridges for each color and the driving gears to selectively control the power via the control unit.

20. A method for disposing of a developer cartridge in a liquid-type image forming apparatus, comprising the steps of:

a) consuming a developer in a first chamber isolated by a sealing member from a second chamber containing an absorber for absorbing liquid;

b) monitoring consumed quantity of a developer of the first chamber;

c) solidifying waste developer in the first chamber by using the absorber of the second chamber based on the monitoring result;

wherein the step c) comprises the steps of:

c1) removing the sealing member to move the absorber of the second chamber into the first chamber; and c2) mixing the absorber of the second chamber with the waste developer of the first chamber; and wherein the step c1) comprises the steps of:

c1-1) rotating backward an agitator mounted in the first chamber;

c1-2) transferring a backward rotational force of the agitator to a collector rotatably mounted in the second chamber; and c1-3) winding and collecting the sealing member by rotating the collector.

21. The method as recited in claim 20, wherein the step b) includes the steps of:

b1) counting the number of dots of inputted print data;

b2) adding up the number of dots counted; and b3) determining whether a developer is consumed completely by comparing the total dot number with a reference value.

22. A method for disposing of a developer cartridge in a liquid-type image forming apparatus, comprising the steps of:

a) consuming a developer of each color stored in a first chamber of each developer cartridge for each color;

b) monitoring a replacement time of a developer cartridge for each color; and c) solidifying waste developer in a developer cartridge to be replaced;

wherein the step c) includes the steps of:

c1) removing a sealing member isolating a first chamber from a second chamber containing an absorber for absorbing a developer; and c2) moving the absorber of the second chamber into the first chamber and mixing the waste developer of the second chamber with the absorber; and wherein the step c1) includes the steps of:

c1-1) rotating backward an agitator of a developer cartridge to be replaced;

c1-2) transferring power of the agitator to a collector rotatably mounted in the second chamber; and c1-3) collecting the sealing member by rotating the collector.

23. The method as recited in claim 22, wherein the step a) includes the steps of:

a1) rotating forward an agitator mounted in a developer cartridge for each color;

a2) supplying the developer of the first chamber to a developing unit.

24. The method as recited in claim 22, wherein the step b) includes the steps of:

b1) counting the number of dots for each color with respect to inputted printing data;

b2) adding up the counted number of dots for each color; and b3) determining a replacement time of a developer cartridge by comparing the total dot number for each color with a reference value.

25. A method for disposing of a developer cartridge in a liquid-type image forming apparatus, comprising the steps of:

a) consuming a developer of each color stored in a first chamber of each developer cartridge for each color;

b) monitoring a replacement time of a developer cartridge for each color; and c) solidifying waste developer in a developer cartridge to be replaced;

wherein the step a) includes the steps of:

a1) rotating forward an agitator mounted in a developer cartridge for each color;

a2) supplying the developer of the first chamber to a developing unit; and wherein the step a1) includes the steps of:

a1-1) rotating backward a driving motor;

a1-2) turning on a intermittent clutch that transfers power from the driving motor to the developer cartridge to be replaced; and a1-3) turning off an intermittent clutch that transfers power from the driving motor to a developer cartridge which is not an object of the developer cartridge replacement.

* * * * *